US006460208B1

(12) United States Patent
Schuster

(10) Patent No.: US 6,460,208 B1
(45) Date of Patent: Oct. 8, 2002

(54) SHAPED BODIES

(75) Inventor: Wilhelm Schuster, Linz (AU)

(73) Assignee: Schukra Geratebau AG, Leonding (AU)

( * ) Notice: Subject to any disclaimer, the term of this patent is extended or adjusted under 35 U.S.C. 154(b) by 0 days.

(21) Appl. No.: 09/485,738

(22) PCT Filed: Aug. 13, 1998

(86) PCT No.: PCT/EP98/05157

§ 371 (c)(1),
(2), (4) Date: May 3, 2000

(87) PCT Pub. No.: WO99/08570

PCT Pub. Date: Feb. 25, 1999

(30) Foreign Application Priority Data

Aug. 14, 1997 (EP) ..... 97114117

(51) Int. Cl.[7] ..... A47C 3/00
(52) U.S. Cl. ..... 5/652; 5/633; 5/640
(58) Field of Search ..... 297/284.4, 284.1, 297/452.29, 452.3, 452.4; 5/652, 633, 640, 657, 648

(56) References Cited

U.S. PATENT DOCUMENTS

| | | | | |
|---|---|---|---|---|
| 3,762,769 A | | 10/1973 | Poschl | |
| 3,973,797 A | * | 8/1976 | Obermeier et al. | 297/284 |
| 4,601,514 A | | 7/1986 | Meiller | |
| 4,968,093 A | * | 11/1990 | Dal Monte | 297/284 |

* cited by examiner

*Primary Examiner*—Jack Lavinder
*Assistant Examiner*—Fredrick Conley
(74) *Attorney, Agent, or Firm*—Grant D. Kang; Robert C. Haldiman; Thompson Coburn LLP

(57) ABSTRACT

Shaped bodies, containing at least one shaped body with an unstressed three-dimensional inherent volume form that has at least one integrated curved part and can be displaced and/or partially or wholly transformed into another three-dimensional volume form by means of an active element connected to the shaped body, using a variable force of pressure/tensile force.

33 Claims, 17 Drawing Sheets

A

B

A

B

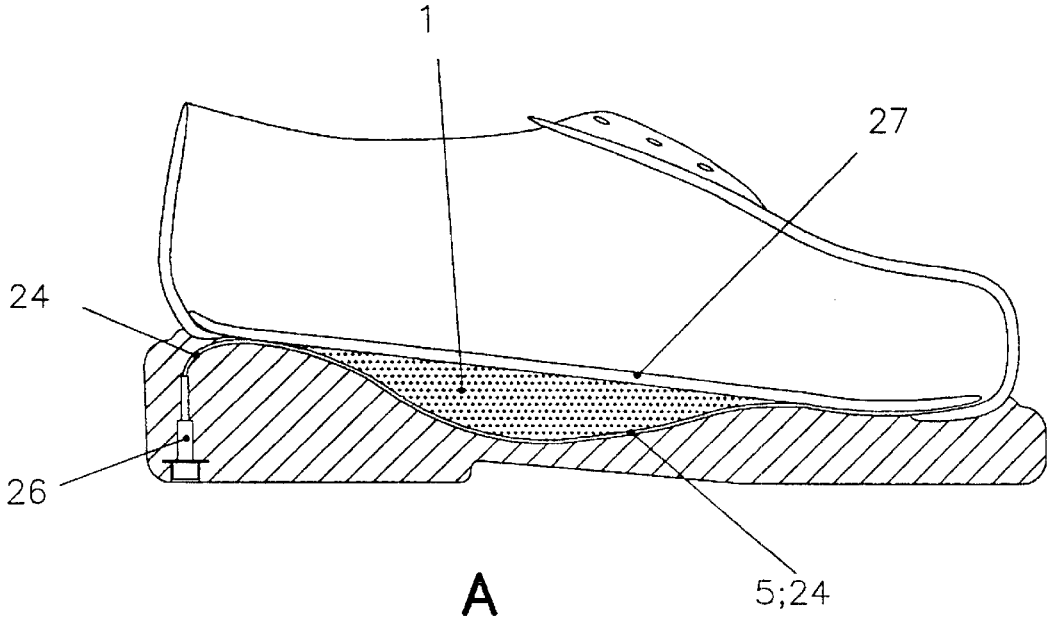
A
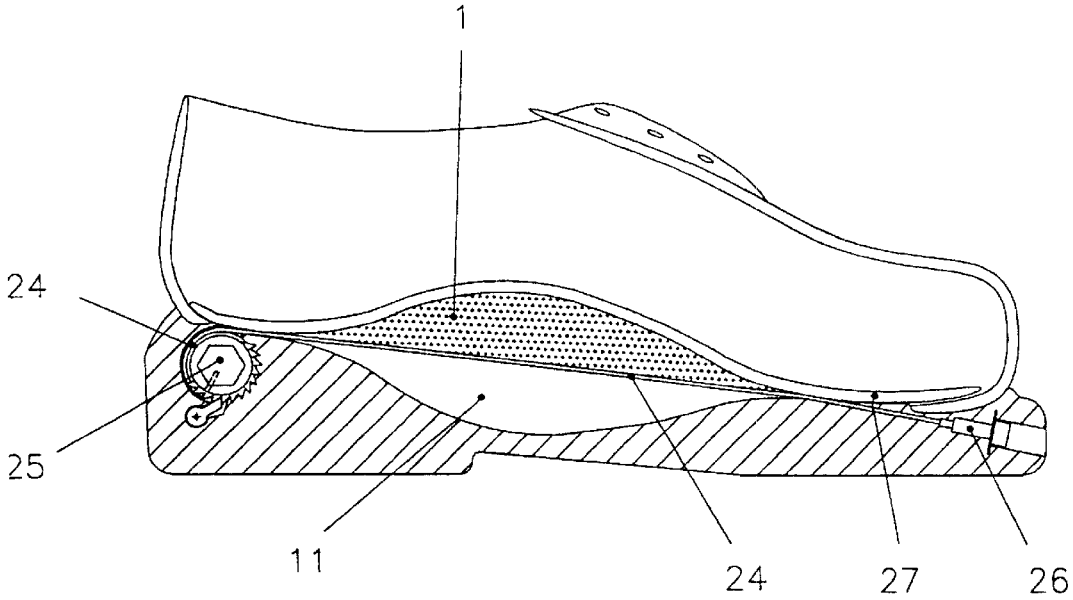
B
Fig.5

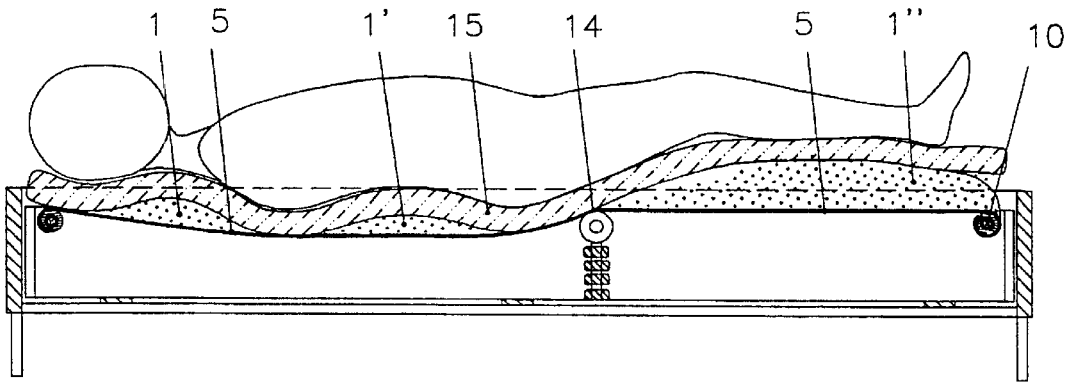
A
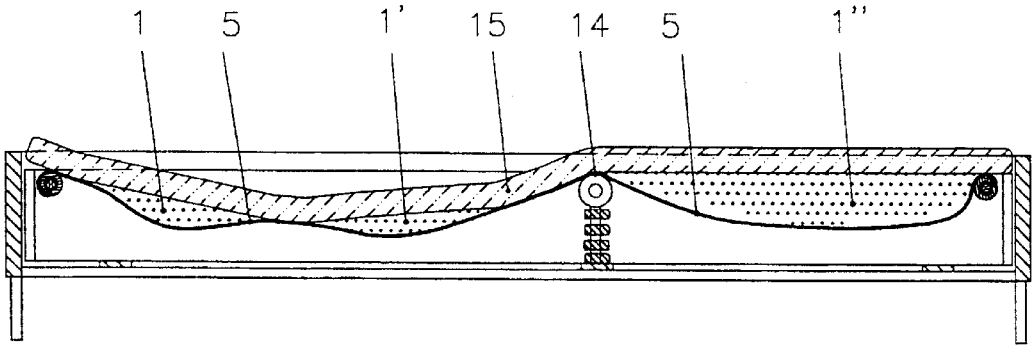
B
Fig.7

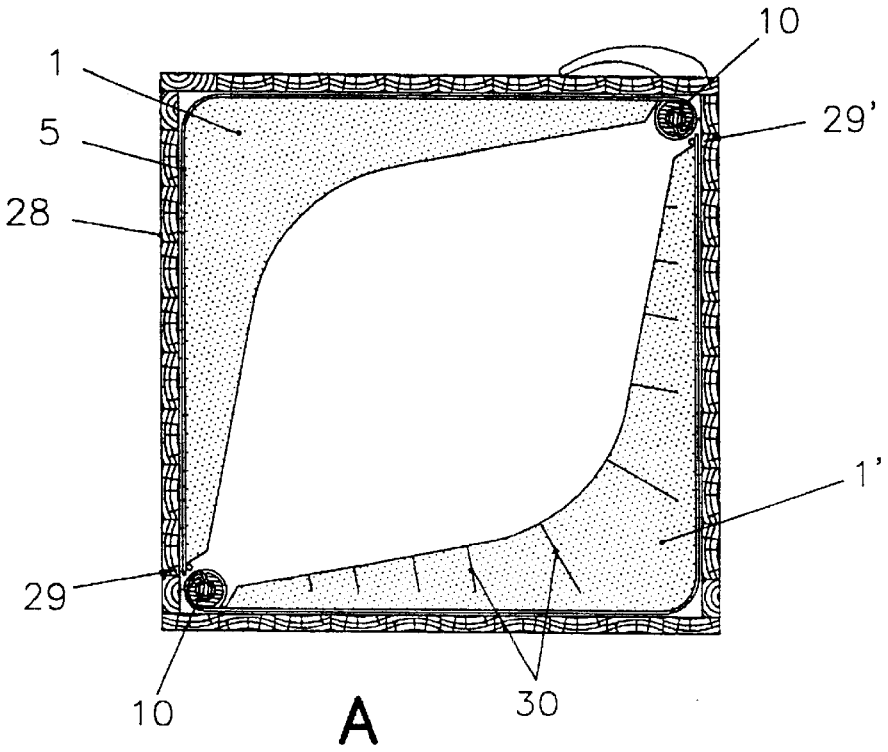
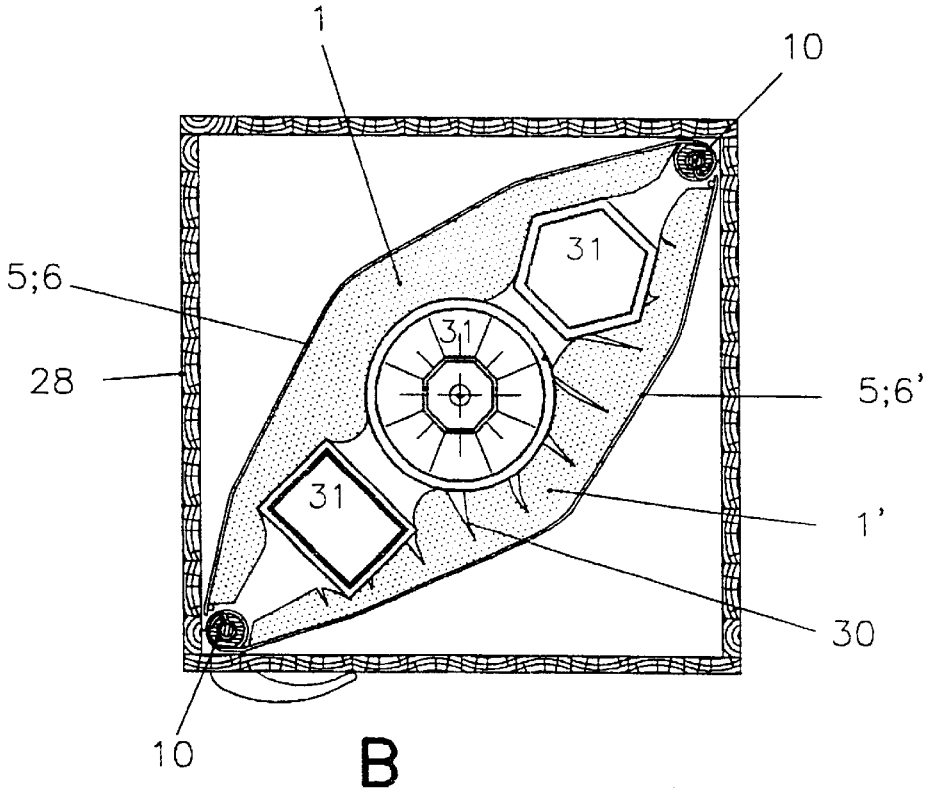
Fig.9

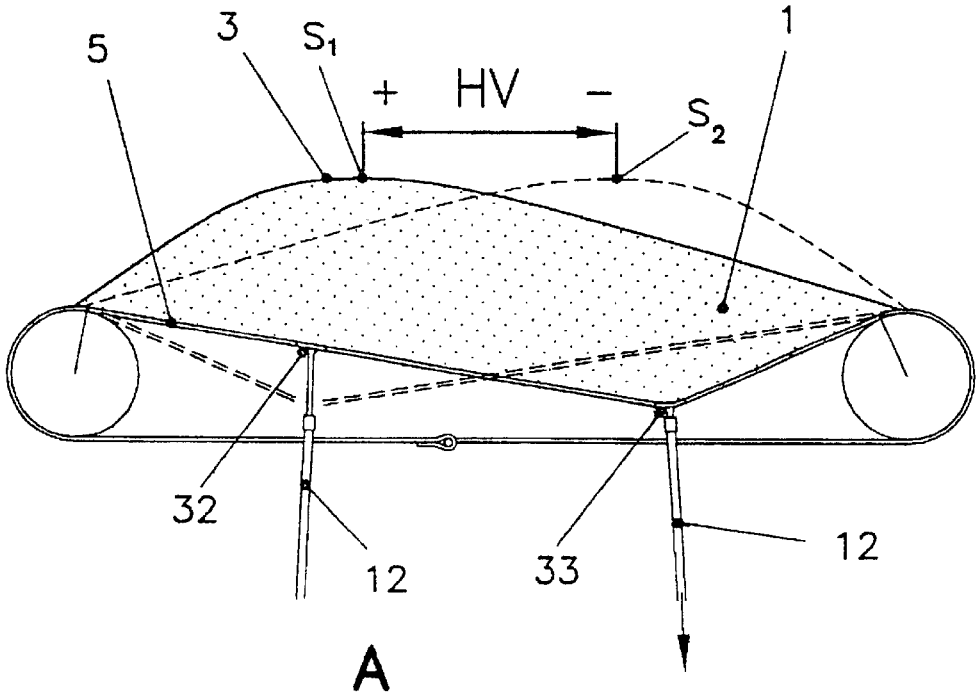
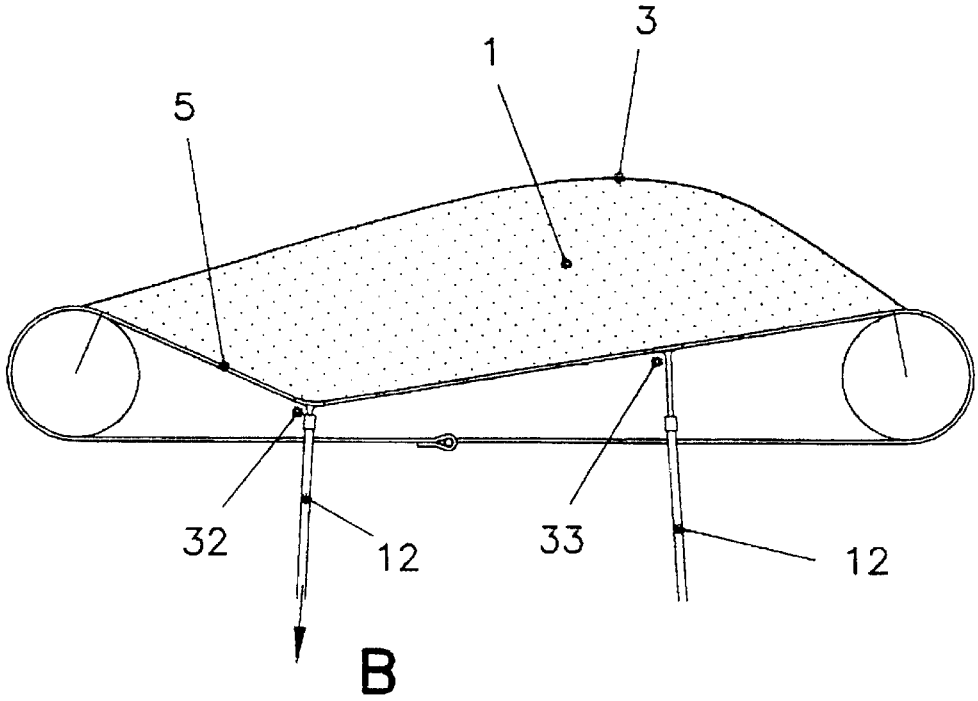
Fig.10

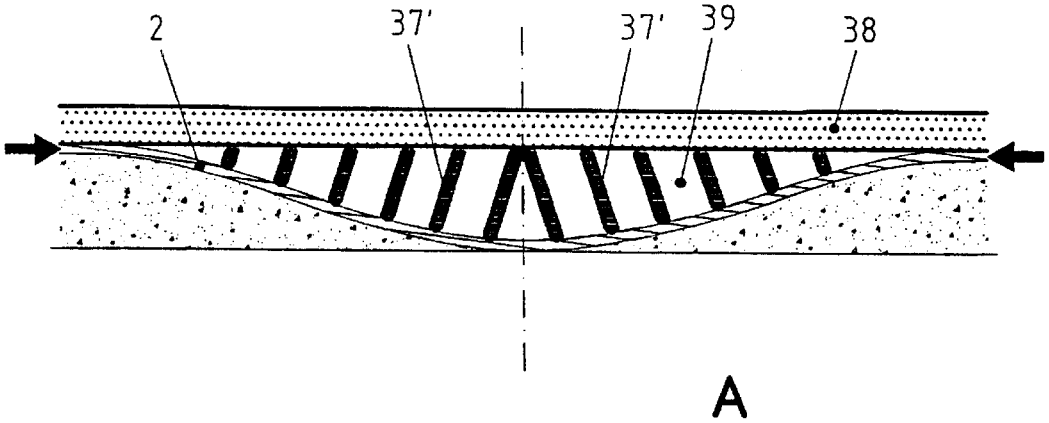
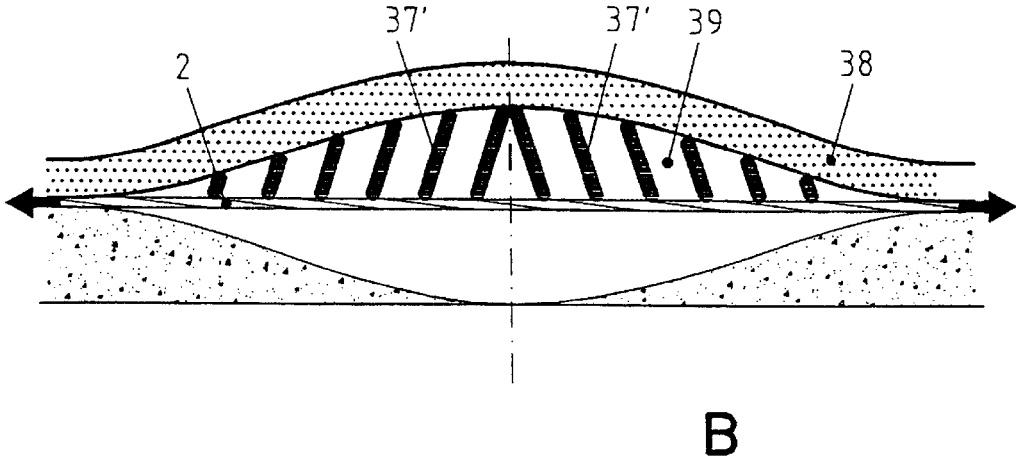
Fig.13

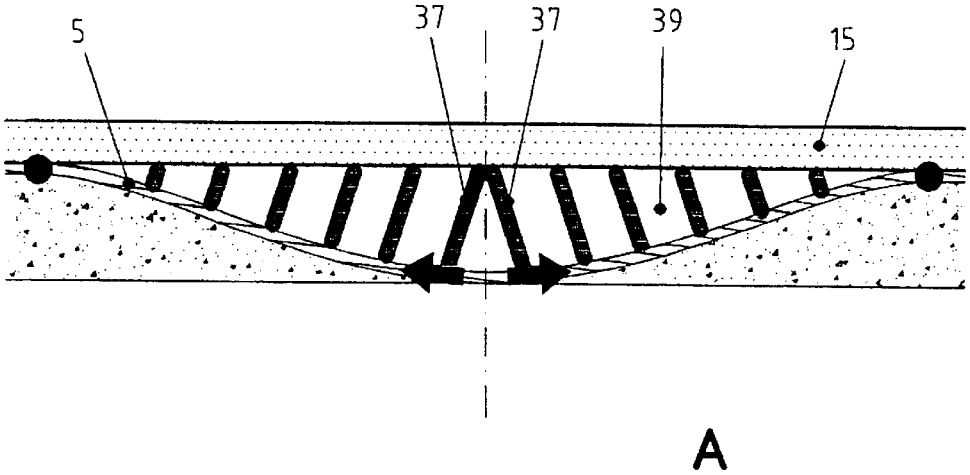
A
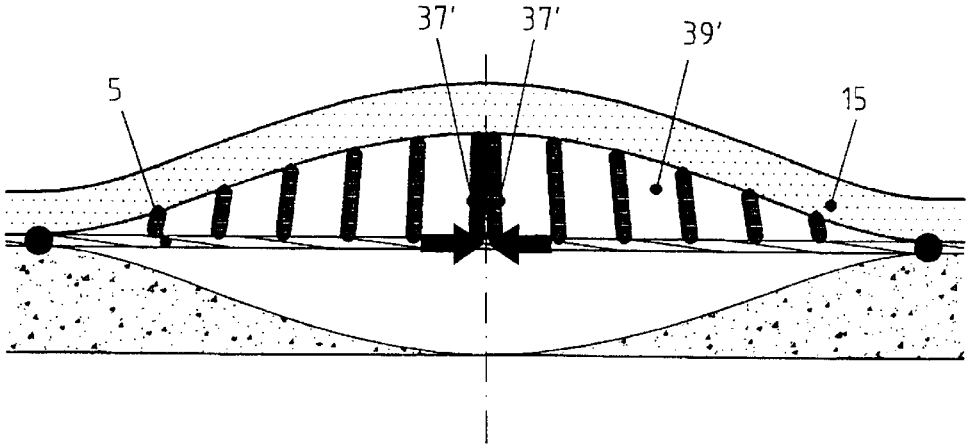
B
Fig.14

SHAPED BODIES

This application claims priority of European Patent Application No. EP-97114117.1 filed Aug. 14, 1997, and PCT Application No. PCT/EP98/05157 filed on Aug. 13, 1998. which is incorporated herein by reference.

BACKGROUND OF THE INVENTION

1. Field of the Invention

This invention relates to shaped bodies, which can be employed in many technical fields. They may, for example, be used in backrests of seat furniture, in order to permit, for example, the individual adaptation of the backrest curvature to the persons sitting on the furniture at that time.

2. Description of Related Art

From German Patent Reference DE 33 24 655 A1 a seat including a lumbar support is known, having an adjustable spring metal sheet acting on the back rest upholstery, with different deformation rigidities in the upper and lower region.

From PCT International Publication WO 94/08492 an adjustable back support including a panel is known, adjustable using an upper and a lower tensioning element, adapted to be adjusted individually.

The shaped bodies can also be used to construct supports of differently shaped building components, during assemblies serving as supports for securing packagings, for the prevention of damage to goods, in the medico-technical field, and for example for couches, orthopaedic shoes and the like in all fields, where certain space configurations should be capable of being modified for optical, technical, medical reasons, and also for example adaptable supports.

SUMMARY OF THE INVENTION

It is one object of this invention to provide three-dimensionally shaped bodies with an integrated convexity, which are able to adopt in a simple and easy manner different space configurations, deviating from the original shape and/or which are adaptable to provide adequate support functions.

This object is attained by a shaped body, having at least one shaped body, with an unloaded three-dimensional inherent volume configuration that includes at least one one-sided integrated convexity, displaceable by means of at least one flexible active element connected along the convexity with the shaped body, by way of applying a variable compressive and/or tensile force onto the flexible active element and/or wholly or partly convertible into a different three-dimensional volume configuration by displacement into itself.

Advantageous embodiments of this invention are discussed in and apparent from the following specification and the claims.

In this invention a shaped body, the unloaded three-dimensional inherent configuration of which has at least one integrated convexity, e.g. any desired triangular cross-sectional shape, can convert wholly or partly into a shaped body with a different inherent configuration by applying force, in which case this applied force and as a result the spatial transformation can take place continuously or incrementally. Maximum deformation is attained by maximum permissible force application; when reducing the force application the deformation is reduced until the original inherent shape is attained again, when completely unloaded.

For example, a wire, ribbon, cord, belt or a strip of plaited artificial or natural fibres or even metal threads, a round or profiled rod of plastics or metal, a sheet metal strip or the like may be used as the active element, in which context merely an adequately flexible resilience and resistance force sufficient for the forces to be applied must be present, at least in the direction of attack and transmission of a force. It is also possible to provide a tensile or pressure element in the direction of tension or pressure with different elasticities, for example by using spring elements, such as for damping and/or to subdivide it, in which case any suitable device may be included between the parts for applying forces to the active elements.

The shape-variable shaped body, may also be a spatial body, having one or more parts, suitable to absorb supporting forces and to transmit these forces to the active elements or vice versa. It may be made of plastics, in particular foam plastics, it may take the form of a cushion body and it may also include nondeformable parts. The shaped body may be composed of individual elements, which themselves form shaped bodies again, which individually or in groups may be movable or stationary in relation to one another, in which context the arrangement on a holding means or carrier or with a flexible cover or in a flexible envelope is possible; the latter may even be elastic. The deformable parts of the shaped body may also be provided on top of or on a non-deformable part, e.g. a core of wood, metal or plastics or they may be composed of a plurality of rigid parts movable in relation to one another. Rests, seats, couches, optical and other advertising means, stage sets, camouflage devices, tools, tool apparatus, support structures and all types of frames, a mattress part, a bed frame, a packing container or a container, shoes and many more may, for example, serve as support means or a carrier. A shaped body may likewise be composed of individual rigid segments, which are connected loosely next to one another or in an articulate manner to an active element, a support, holding means or the like. The latter may be one part, and it may be made of plastics.

Any device, capable of exerting force on the shaped body or bodies by way of the active element, may serve for the modification of the forces to be applied, in which case the active elements may in the process be both stressed and unstressed. An arrangement permitting the application of pressure onto each shaped body is likewise possible. The device may be driven mechanically or by a motor and may be operated directly or by remote control, e.g. by means of a Bowden cable or rods or even pneumatically, hydraulically, electrically or by wireless means.

The connection between the shaped bodies and each active element may be effected in any desired way, e.g. by adhesives, welding, riveting etc., in individual cases also by mere friction, e.g. if the shaped body is arranged in a closed envelope.

BRIEF DESCRIPTION OF THE DRAWINGS

This invention will be described in more detail according to and by way of working examples wherein:

FIG. 5 shows a shoe with a shape-variable shaped body, in cross-section;

FIG. 7 shows a bed with three shape-variable shaped bodies, in cross-section;

FIG. 9 shows a section of a transport container including two variable shaped bodies arranged therein for stabilizing transport goods;

FIG. 10 shows a cross-section of a shape body, whereon at two staggered locations active elements attack in order to displace and change the shape and the vertex;

FIG. 13 shows cross-sections of a second embodiment of a shaped body comprising spaced apart segments;

FIG. 14 shows cross-sections of a third embodiment of a shaped body comprising spaced apart segments, the body configuration and volume of which are variable;

DESCRIPTION OF PREFERRED EMBODIMENTS

Figure 1:
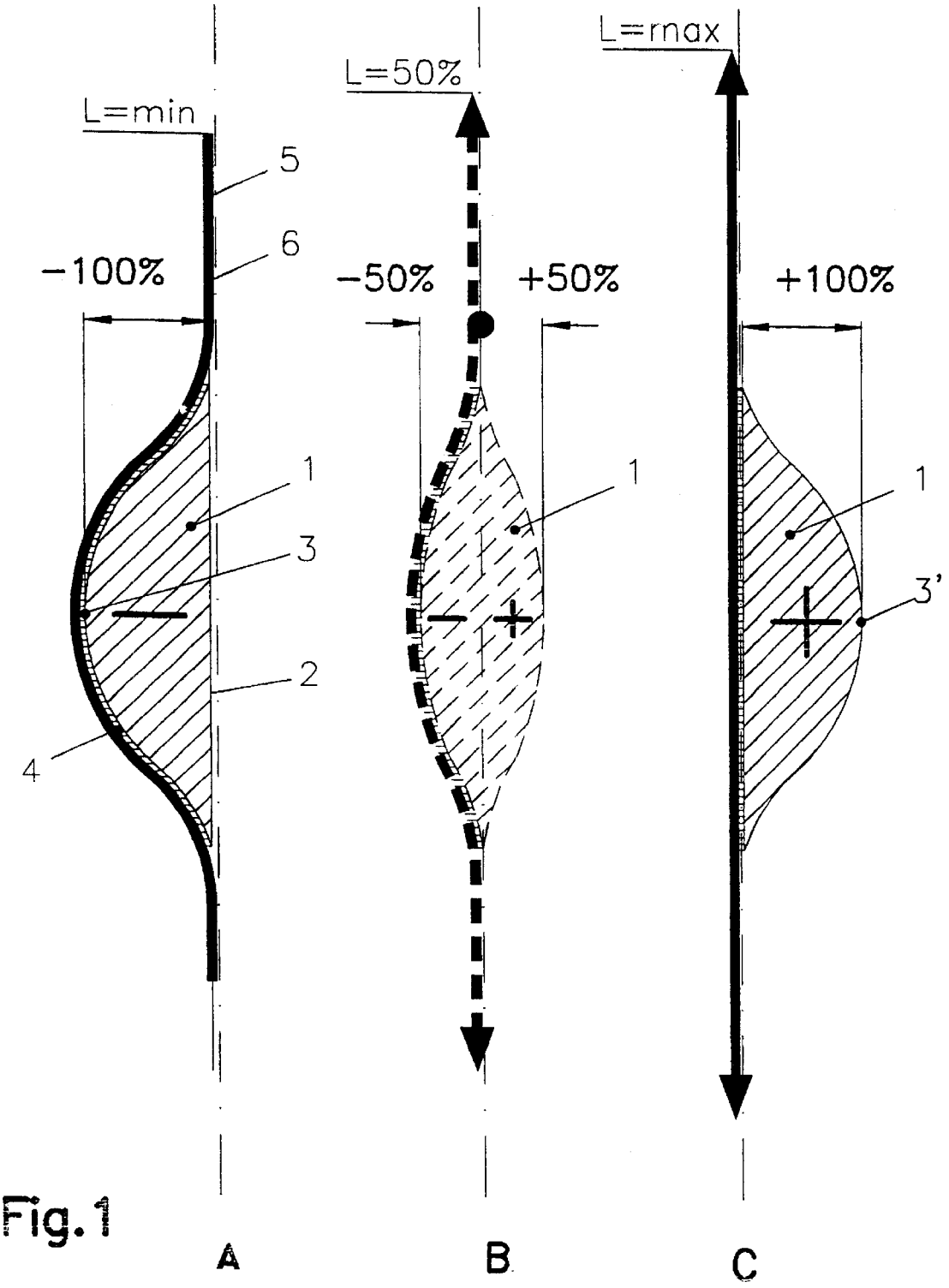
FIG. 1 is an embodiment of a shape-variable shaped body in three positions, in a diagrammatic view.

In FIG. 1 a basic concept of this invention is shown by way of a shape-variable shaped body 1 in three different shapes. The shaped body 1 is shown in FIG. 1A in its position of rest, for example in its inherent configuration, representing one embodiment of a level base 2 and a convexity 3, designed in cross-section in the embodiment symmetrically as a rounded isosceles triangle, but which may also be asymmetrical. Along the convexity 3 an active element 5 of optional type, e.g. in the form of a flexible tensile strip 6, is fitted by a connecting means 4, which may, for example be a resilient adhesive. The shape-variable and resilient shaped body 1 is designed slightly stretchable in a longitudinal direction, from top to bottom in FIG. 1A, whereas it is nearly pressure resistant in a transverse direction. If a tensile force is applied to the tensile strip 6 on one end, the other end behind the shaped body 1 then being fixed in position, or if a tensile force is applied to both ends, see arrows in FIG. 1B, the tensile strip 6 begins to stretch, pressing the shaped body I forward, elastically deforming it, until it reaches the final position shown in FIG. 1C, in which the shaped body 1 has a mirror image configuration in relation to the original position, and the convexity 3' then faces the side opposite the original position. If the tensile forces are slowly or spontaneously reduced and ultimately cancelled, the shaped body 1 returns from the configuration shown in FIG. 1C to that shown in FIG. 1A under its inherent tension/inherent resilience. By adjusting the tensile force from zero to a value, at which the tensile strip 6 is completely stretched, any desired position or convexity of the shaped body 1 can be set between the two original positions.

Figure 2:
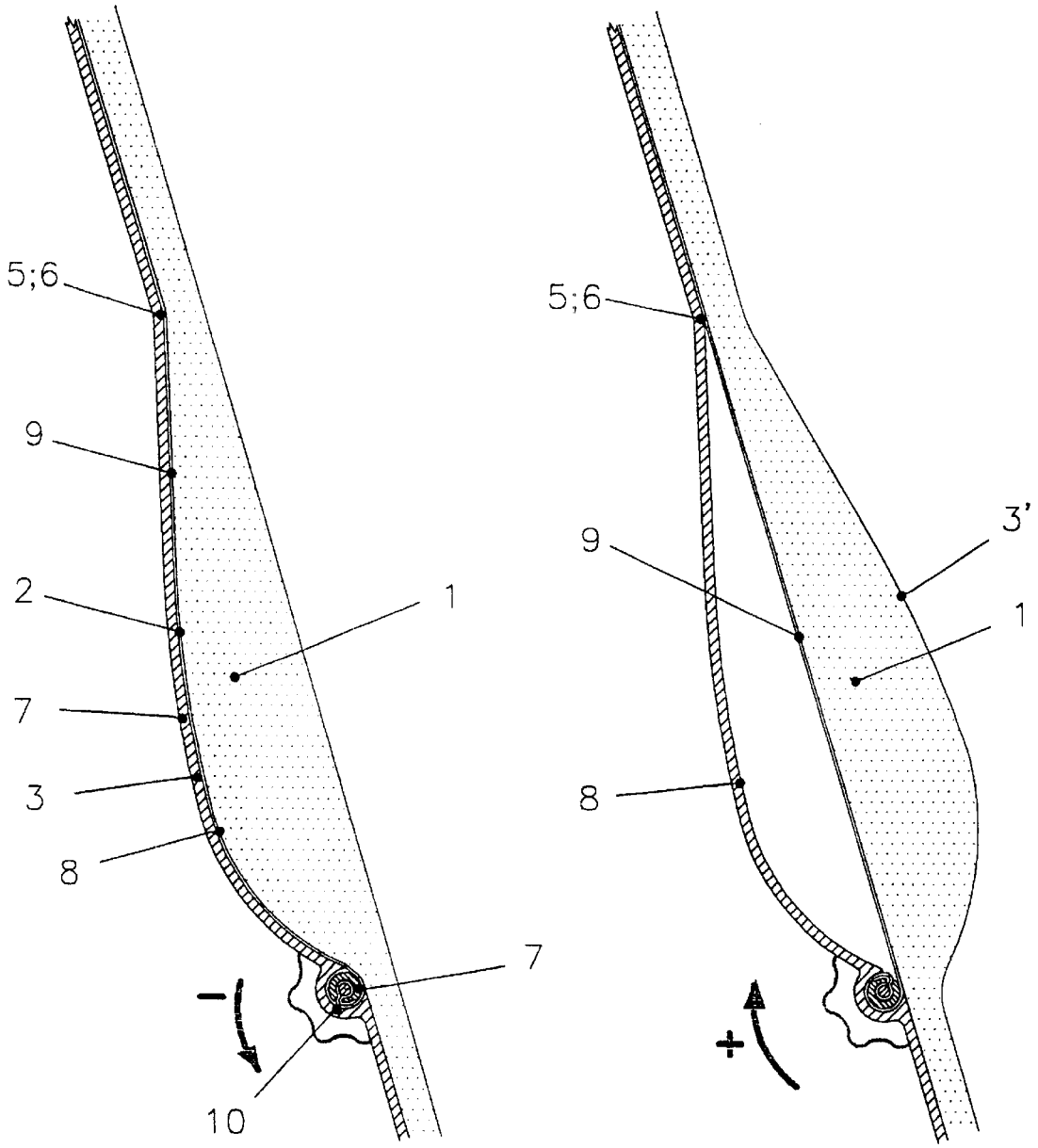
FIG. 2 is a section of a backrest with a shape-variable shaped body, in cross-section.

The embodiment shown in FIG. 2 in two positions, shows a seat backrest with a support structure 7, such as in the form of a shell, comprising a trough-shaped concavity 8. Above the concavity 8 an active element 5 in the form of a tension belt 9 is fitted, designed in such a manner as to be able to rest non-stressed in the concavity 8. In the end region or underneath the concavity 8 a device 10 is fixed to the shell, by means of which forces are transmitted onto the tension belt 9. The device 10 may for example be a coiling apparatus for a tension strip 6 or a tension belt 9 or even a rope or a cloth strip. Inside the shell a shaped body 1 in the form of a back support is provided, in which context the back support has a convexity 3, corresponding in its form to the concavity 8 or vice versa. In particular the parts of the back support without convexity, situated in the upper and lower portion outside the concavity 8 of the shell, may be releasably or permanently fifted. A releasable connection can be brought about, for example by Velcro™ fasteners or by snap fasteners. A conceivable fixation of the tension belt 9 in the region of the convexity 3 is not required in the present case, as frictional contact exists with the shaped body 1. In the original position inherent to the back support, the convexity 3 abuts the shell in the concavity 8, just like the tension belt 9. Should an individual adaptation of the shaped body 1, serving as a lumbar support, to the concrete shape of the person using the back rest, be performed now, the tension belt 9 is coiled up by the device 10, in the form of a coiling device, causing it to become tensioned and assuming in the final stage the linearly stretched position shown in FIG. 2B. During coiling the convexity 3 is moved continuously from the concavity 8 and is displaced outwardly until the shaped body 1 in its final stage assumes the convexity 3', now directed outwardly as shown in FIG. 2B. If the tension belt 9 is uncoiled again by the coiling device, the convexity of the backrest returns again into the originally specified original shape and position due at least to its inherent resilience or the force of tensioning. By means of a locking device, not shown, or a self-locking tensioning device coiling and, as a result, the tensile force applied to the tension belt 9 can be stopped in any position, so that the individual adaptation can be retained.

A simple embodiment, not illustrated, comprises a shaped body as described in FIG. 1, the convexity of which is connected to a web, such as of fabric, serving as the active element. The upper free end of the web of fabric is fixed, for example on a cross beam while a coiling device is fixed in its position underneath the shaped body, by means of which coiling and uncoiling of the fabric web and thus its tensioning and, as a result, also the modification of shape of the shaped body becomes possible.

Figure 3:
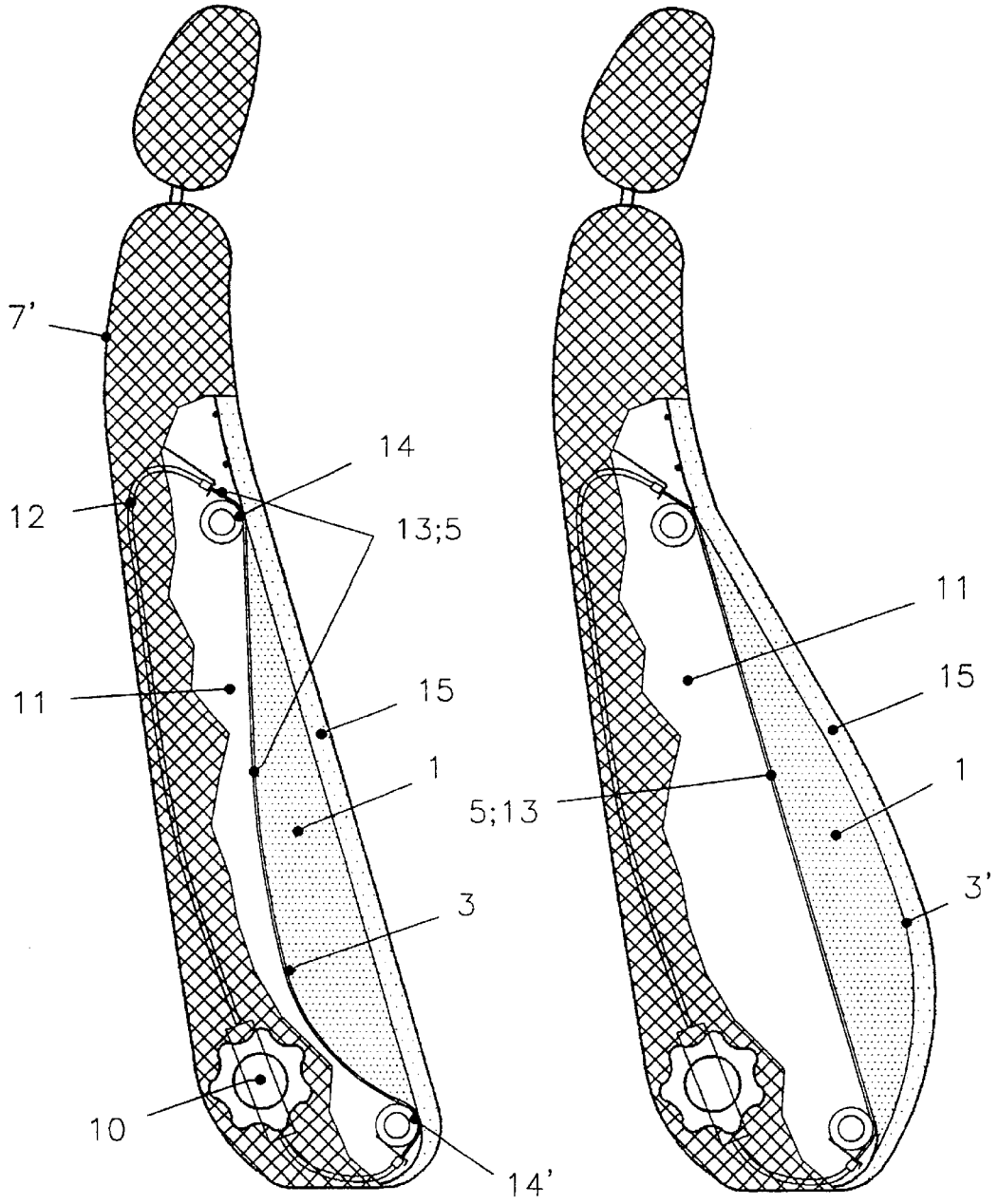
FIG. 3 is a different backrest with a shape-variable shaped body, in cross-section.

The back including the head rest shown in FIG. 3 comprises a support structure 7' in the form of a rigid foam back part, on which a head rest is provided in the upper region, comprising a cavity 11, serving for the accommodation of the shape-variable shaped body 1. In this case the device 10 for the application of forces is self-locking and connected to a Bowden cable arrangement 12, in which context a portion of the cable arrangement 13 is connected to the convexity 3 of the shaped body 1. The cable arrangement 13 is guided around two deflecting points 14, 14'. The Bowden cable arrangement 12 may have any device 10 for applying forces, in the present case for shortening and lengthening the cable arrangement 13, by which the desired deformation of the shaped body 1 is brought about, as described above. On that side against which the user is leaning, a flexible cover 15 covering the cavity 11 and the shaped body 1 is provided on the sturdy back part, which may likewise serve as upholstery or for absorption and which abuts loosely against the shaped body 1 or may also be connected to the shaped body 1.

A further modification of the embodiment resides in that either at the upper or the lower end or even at both ends the tension strips or belts are deflected at the holding means and are passed to the rear side. Because of the two deflection points 14, 14' it is possible to arrange the device 10 for applying the active forces in the rearward, i.e. hidden, region. Preferably, the friction, increased by the deflection, may be reduced by suitable measures, such as for example rolling bodies provided on axles. If, as shown in FIG. 3, deflection takes place at the top and at the bottom, it is also possible, while adhering to the modified shape of the shaped body 1, set in each particular case, to move the shaped body 1 up and down. This may be done, for example, because one of the deflection points 14 or 14' is designed for the cable arrangement 13 as a rotary bearing, not shown, e.g. by using a rotatable bushing, around which the cable arrangement 13 is guided, optionally with a complete wrap. By turning the bushing, optionally by means of suitable expedients, the up and down adjustment of the shaped body 1 can be performed, in the course of which the device 10 for the application of forces must not impair this movement. The device 10 for the application of forces may itself be designed to move up and down, so that by its up and down movement the level adjustment can be performed in each particular case.

Figure 4:
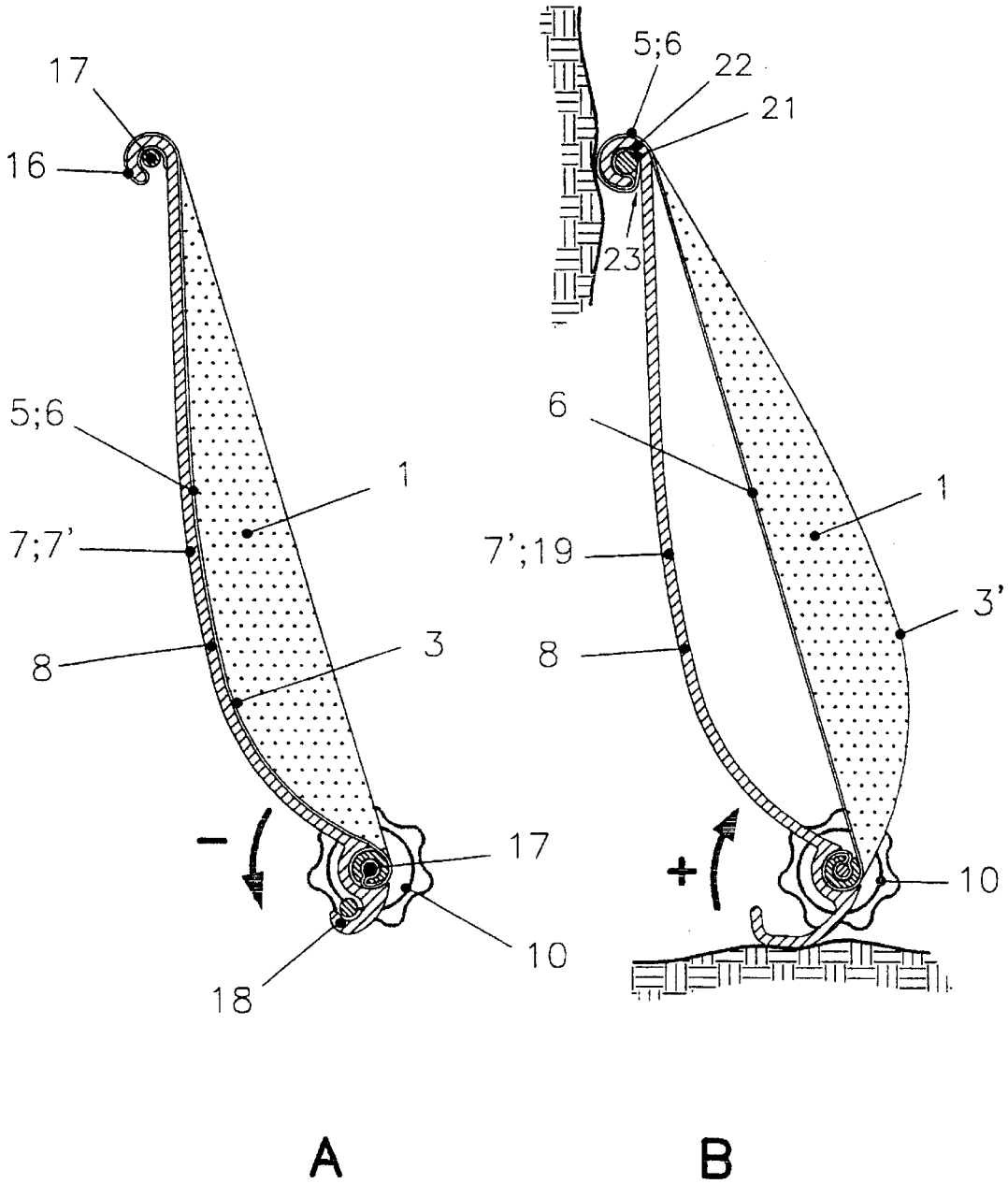
FIG. 4 shows two further embodiments of backrests, one as a fitted module and another as a loose cushion, each in cross-section.

FIG. 4 shows two embodiments of a backrest. The embodiment shown in FIG. 4A represents an independent module, which can, for example, be locked, e.g. hinged, as a whole in a seat frame without any tool. The embodiment illustrated in FIG. 4B is designed as a mobile, transportable backrest. The shaped body 1 of the backrests corresponds with regard to configuration and function to the above described shaped bodies 1, so that in the following deviations only will be pointed out. In both examples an active element 5 in the form of a tensile element 6 is likewise provided, fitted to the upper end of an upper end piece 16, shown in FIG. 4A, which takes the form of a hook in the present example. The hook-shaped end piece 16 is adapted to be hooked, for example, to a transverse rod 17, forming part, for example, of a seat frame or support structure 7. The lower end of the tensile element 6 communicates with the device 10 for applying forces, which may be designed as a coiling device including an eccentric means. By means of the eccentric means the adjustment characteristics may be modified, e.g. first rapidly with little force and then slowly with increasing force. The hook-shaped end piece 16 may be connected to a back panel 7' or may form an integral part of it. At the lower end of the back panel 7' or on the seat frame, respectively, hooks 18, clamps, eyelets or the like are provided by means of which the module can be fifted to the seat frame, preferably without any tools. The module may have any desired support structure, even without a back panel.

In the embodiment shown in FIG. 4B a closed, but in any event U-shaped frame 19 with a back panel 7' and a base 20, e.g. a skid or the like is provided. The frame 19 may also be designed as a shell, into which a concavity 8 is integrated. At the upper end the active element 5, e.g. a fabric web, is fitted to a support rod 21, adapted to be inserted into a tube 22 having a gap 23 in order to introduce the fabric web into the frame 19. The active element 5 may also comprise a plurality of tension belts, arranged side-by-side, in which context their attachment, e.g. to a coiling device may be effected on axle journals having different outer diameters, so that during rotation of the jointly shared axle the tension belts can be rolled up at different speeds, which also permits exercising a certain effect in transverse direction on the shaped bodies 1, e.g. lateral support. It is also possible to provide a plurality of coiling devices, which can be activated individually or by any desired interconnection. Active elements can, of course, also attack in transverse direction, in order to act on the backrest cross-section.

It stands to reason that in all described embodiments the device 10 for applying forces, such as coiling or tensioning devices, may also be arranged at the upper end of the backrest and that actuation may also be performed from a distance, e.g. by a Bowden cable arrangement. A motor-driven means, driven electrically, hydraulically or pneumatically can also be employed. By making use of endless screws, threads, eccentric means etc., the coiling or tensioning device may also have self-locking properties, which automatically ensure locking in any desired position by an adjustment by means of a handwheel or a lever, without having to employ locking means, which have to be actuated specifically or by releasable latching devices.

FIG. 5 shows a shoe including an orthopaedic support by means of a shape-variable shaped body 1. In this case the adjustment of the active element 5, e.g. in the form of a tensioning cord 24, may be performed by a reeling device 25, shown in FIG. 5B, adapted to be shifted and locked or by a Bowden cable arrangement including a screw spindle 26. The shaped body 1 is covered by a flexible shoe sole 27.

Figure 6:
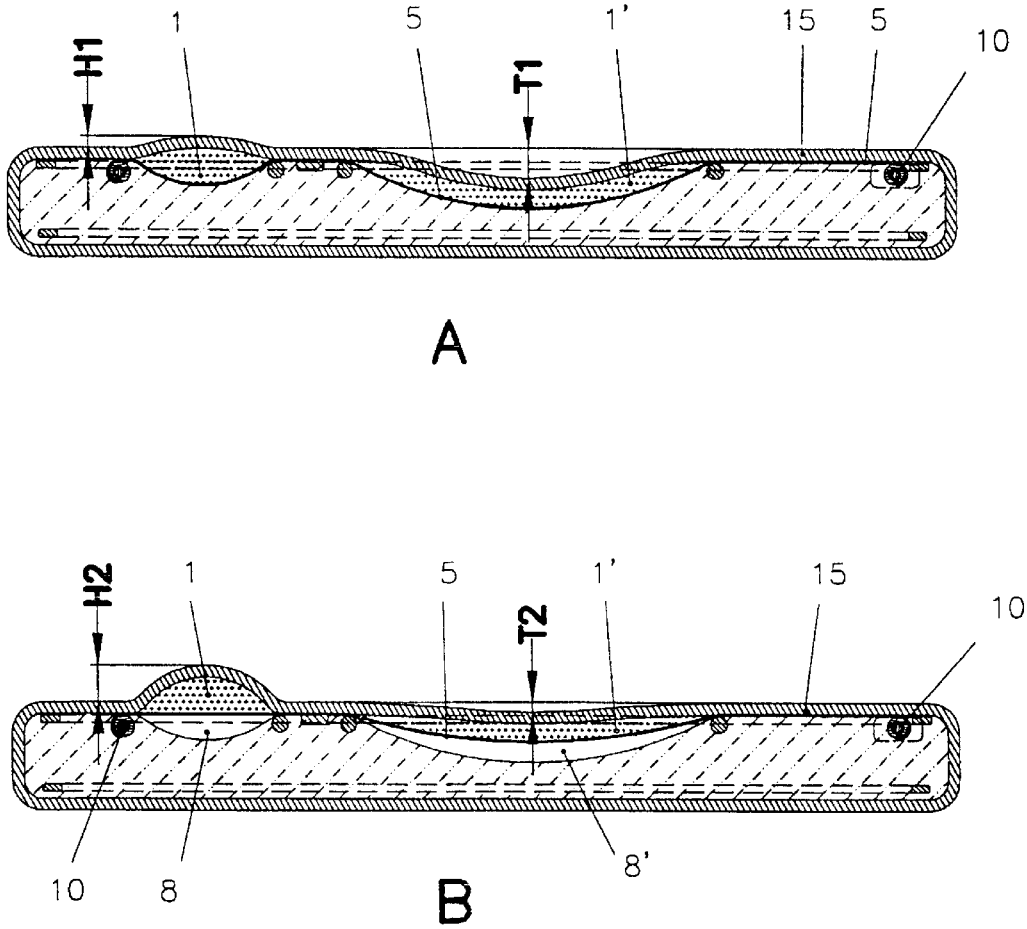
FIG. 6 shows a mattress with two shape-variable shaped bodies, in cross-section.

FIG. 6 shows a mattress, comprising two shape-variable shaped bodies 1 and 1' in the longitudinal direction, one in the head region and one in the lumbar region. In this case frame elements are provided, to which the active elements 5 and/or the devices 10 for applying forces can be fifted, in which context deflections and supports may be provided, if required. The mattress further comprises a body, e.g. a foam body, in which concavities 8, 8' and/or gaps for the shaped bodies 1 and 1' are provided, as well as a closed cover 15.

FIG. 7 shows an application of the invention within a bed frame, where three shape variable shaped bodies 1, 1', 1' are provided in the longitudinal direction, permitting an action similar to that of a slatted bed frame.

Figure 8:
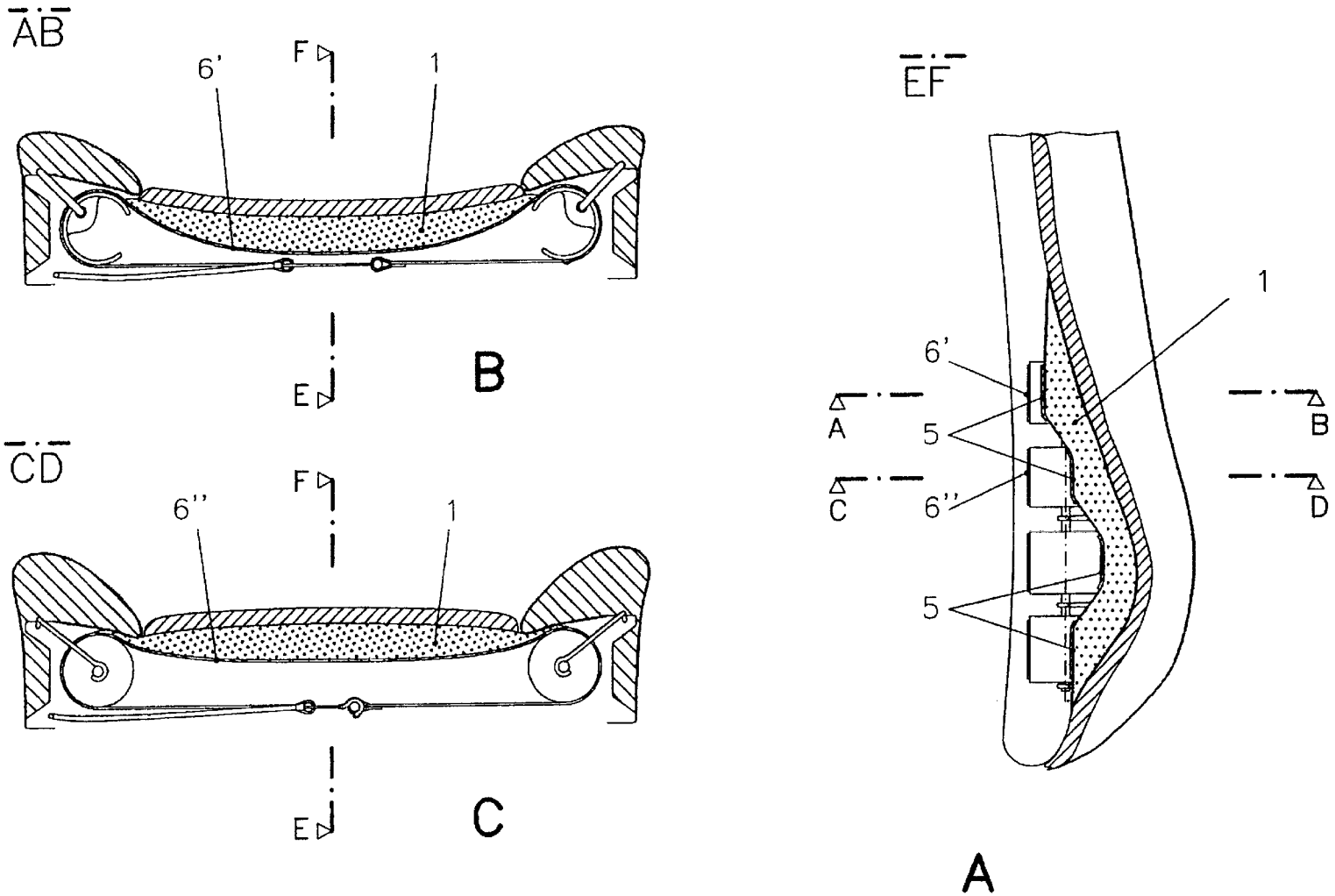
FIG. 8 shows a longitudinal section (A) and two cross-sections (B, C) of a seat backrest including a shaped body extending in longitudinal, vertical and transverse directions, on which the active elements engage in the vertical as well as in the transverse direction.

FIG. 8 shows a vertical section taken through the back of a seat, shown in FIG. 8A, in which a shaped body 1 is illustrated, adapted to vary its shape in vertical and transverse directions, associated further with transversely directed active elements 5 in the form of tension strips 6, 6", in order to attain a deformation also over the cross-section, see FIG. 8B and C, in which case it is also possible to provide merely one active element or further such active elements in the transverse direction.

FIG. 9 shows a cross-section taken through a packaging container 28 including two boomerang-shaped, shape-variable shaped bodies 1, 1', the wings of which abut in each case the adjacent walls of the packaging container 28. On the surfaces of the shaped bodies 1, 1' bearing against the walls, tension belts 6, 6' are provided to serve as active elements 5, fifted to one end, close to one of the comers 29, 29', shown in FIG. 9A, of the packaging container 28, in which the two shaped bodies 1 and 1' meet, and inserted at the other end into a selflocking tensioning or coiling device serving as the device 10 for applying forces. In one or both shaped bodies 1, 1' incisions 30 and/or wedge-like openings may be provided, permitting better adaptation of the variable shaped bodies 1, 1' to the prevailing shapes of transport goods 31 or even facilitating a modification of shape. In FIG. 9B transport protection is shown on three different goods 31 by means of the shape-variable shaped bodies 1, 1'. For specific purposes the use of only one or a larger number of shaped bodies 1 is possible for a packaging container 28 of any desired shape. The original shape as well of the variable shaped bodies 1, 1' may be adapted in advance to any desired goods 31 to be packed.

For the majority of embodiments described up to now the modification of a predetermined variable shaped body takes place only until it reaches its negative or mirror-image shape, i.e. the deformation is virtually a displacement in itself. Examples will still be set out hereafter, where an additional modification is or additional modifications are provided by one or more superimposed force applications.

FIG. 10 shows the influence of forces at two spaced apart locations 32 and 33 on the active element 5, connected to a shaped body 1, permitting in the embodiment a vertex displacement of a convexity 3 from S1 to S2 and back, depending on the predetermined original shape, in which case at the two spaced apart locations 32 and 33 tensile forces of any desired combination, as the case may be, even compressive forces, may be applied onto or reduced from the active element 5 with varying intensity. This causes a broad variation of the modification of the shaped body 1, which can be further modified by modifying the position and/or the number of the points of engagement 32, 33. It is also possible to provide further active elements 5, which permit the transmission of forces in any further direction, so that the shaped body 1 can be subjected to further deformations, in which case further main and side effects, such as vibration and/or massage movements, can be attained.

Figure 11:
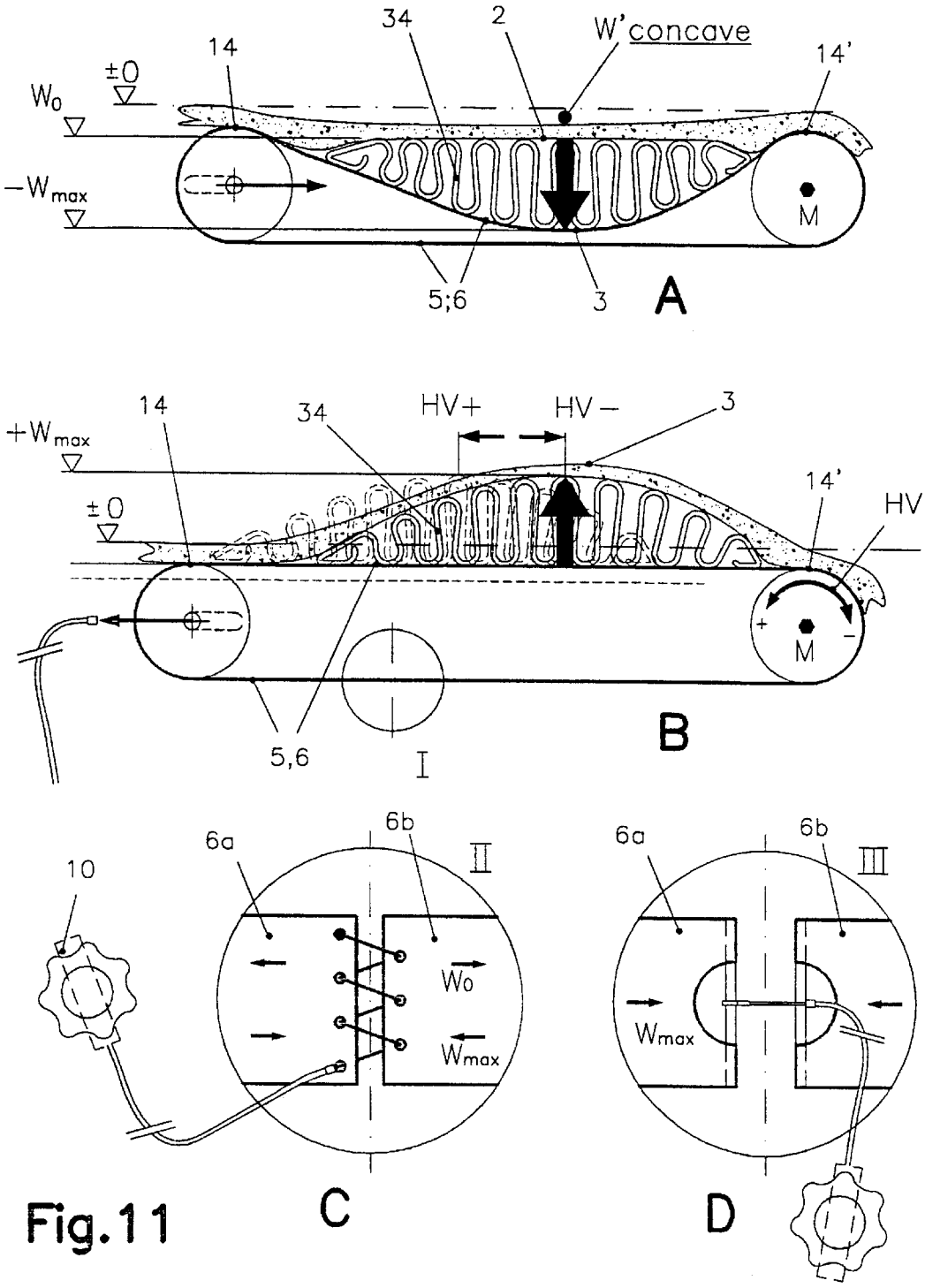
FIG. 11 shows cross-sections of a shaped body, adapted to stretch in the longitudinal direction and rigid and pressure-resistant in the transverse direction.

FIG. 11 shows a shaped body 34 in the form of a resilient body, stretchable in longitudinal direction, in the transverse direction having rigid, approximately parallel folds with an increasing and then decreasing fold height, such as in its original shape it has a linear base 2 and a convexity 3. In the embodiment shown, the active element 5, a tension strip 6, associated with the shaped body 34 is guided around two deflection points 14, 14', the two ends 6a and 6b of the tension strip 6, as shown in FIG. 11C and D, being interconnected by means of a device 35, adjusting the spacing of the ends 6a and 6b from one another. In addition, one of the deflection points 14 or 14' is arranged in a distance-adjustable manner in relation to the other. If the two deflection points 14, 14', as shown in FIG. 11A, are positioned as closely together as possible, the tension strip 6 is unstressed and the shaped body 34 is present in its predetermined original state. In this case the respective terminal fold may be anchored on the active element 5. By varying the spacing in the sense of moving the deflection points 14, 14' away from one another, e.g. by shifting the axis of a deflection roll forming the deflection point, the active element 5 expands and stretches the shaped body 34, displacing it at the same time. The displacement may be effected additionally or also solely in that, as described above, the spacing between the strip ends 6*a* and 6*b* is adjusted. Two possible, modifications are illustrated in FIG. 11C and FIG. 11D, both comprising an adjustment mechanism including a Bowden cable arrangement. If one of the two deflection rolls is turned about its own axis, a displacement of the vertex of the opposite convexity 3' is caused.

Figure 12:
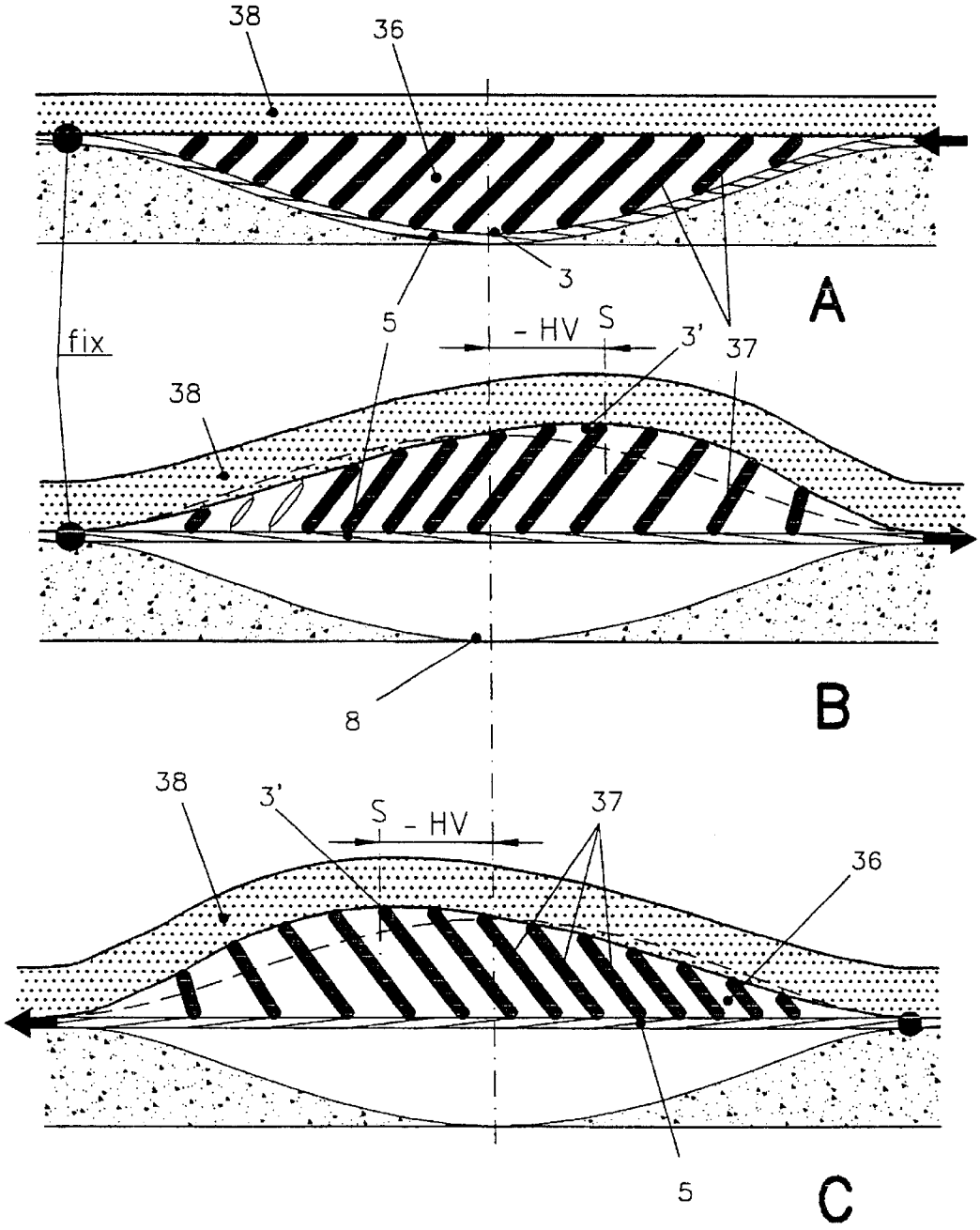
FIG. 12 shows cross-sections of a shaped body including spaced apart segments, the body configuration and the volume of which is variable.

FIG. 12 illustrates a further modification of a device for modifying a shaped body and for the additional displaceability of the vertex of the displaced convexity 3' of a shaped body 36. In this case the shaped body 36 comprises segments 37, fitted to any desired flexible support 38 in an articulate manner in spaced apart relationship, their other ends being likewise fitted in an articulate manner to a flexible active element 5. In this case the segments 37 are disposed at an angle In relation to the horizontal line. In the embodiment shown, the heights of the individual segments 37 in relation to the horizontal line are so selected that their vertexes describe a curve, i.e. a convexity 3. If the active element 5 is fitted to one end and if tension is applied on the other end until it is completely stretched, then not only a convexity 3' is attained in the opposite direction, but also a vertex displacement, depending on the angle setting and the displacement of the active element 5 from the concavity 8 into the stretched position, as shown in FIG. 12B. If the setting of the fixing point and the direction of tension are changed on the active element 5, a vertex displacement takes place in the opposite direction, as shown in FIG. 12C.

The embodiment illustrated in FIG. 13 shows a structure, similar to the one described in FIG. 12; in this case, however, a shaped body 39 is provided, in which, symmetrically to the central line the individual segments 37' of the right side, as opposed to those of the left side, are disposed symmetrically but at opposed angles to the horizontal line and are connected in an articulate manner to the active element 5 or the support 38. A uniform convexity is attained because from both ends an even tension is applied to the active element 5. If the tension is applied unevenly from both ends, a displacement of the vertex can again be brought about within certain limits.

In the embodiment illustrated in FIG. 14 the shaped body 39' has the configuration described in FIG. 13. In this case, however, the active element 5 is fixed to both ends and is separated in the center between the two segments 37' having an opposed angle arrangement and provided with a device 35' for the adjustment of the spacing between the separated ends. If the ends touch, i.e. if the spacing becomes zero, the curved position of the shaped body 39 is attained, as shown in FIG. 14B.

Figure 15:
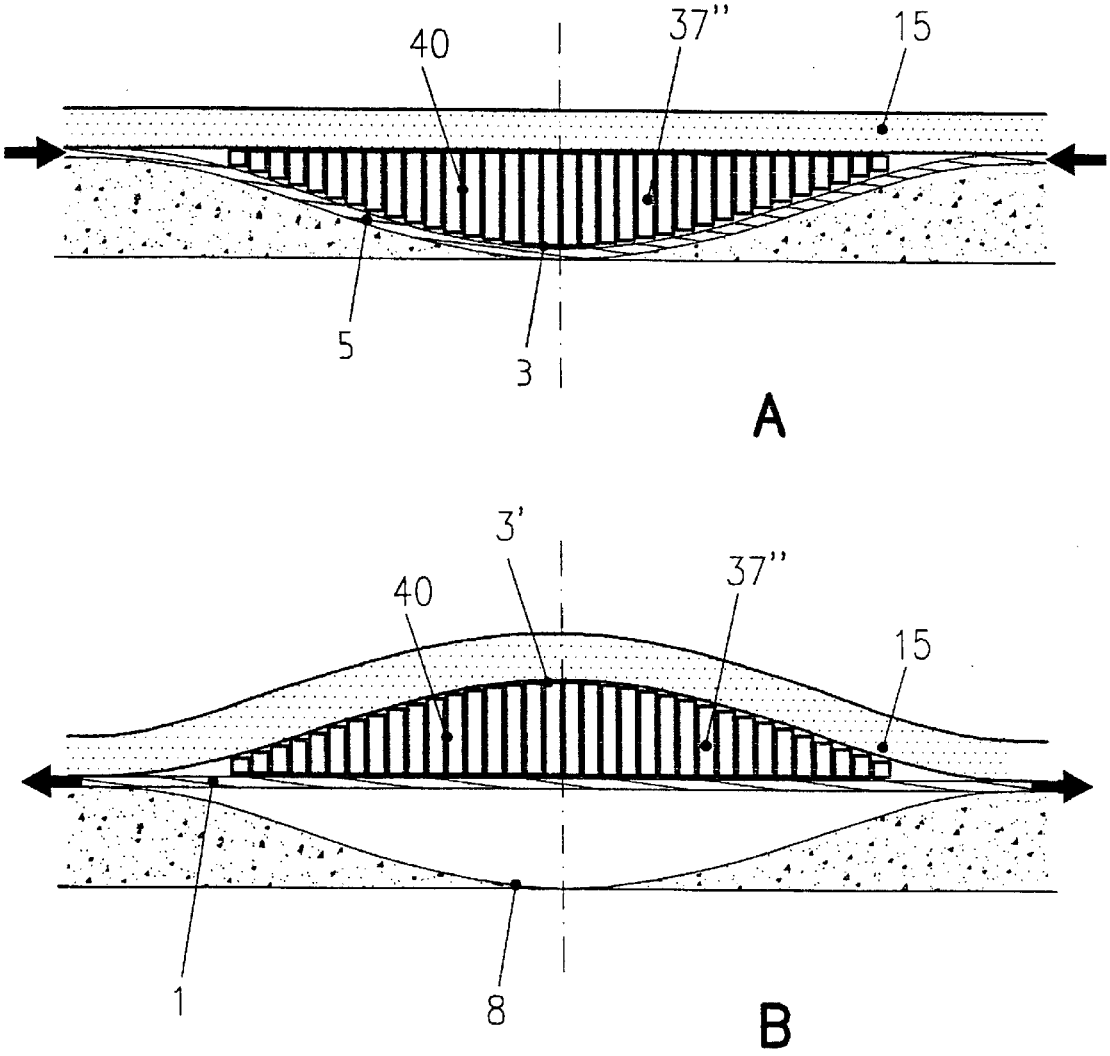
FIG. 15 shows cross-sections of a shaped body comprising segments, arranged one against the other in a sleeve.

FIG. 15 shows an embodiment of a shaped body 40, comprising individual segments 37", which, freely movable in relation to one another, but deriving support from one another, form a shaped body 40 having a downwardly directed convexity 3. Underneath the shaped body 40 an active element 5 is provided in a concavity 8, corresponding to the convexity 3 while a flexible cover 15 is disposed above the shaped body 40. In this embodiment, forming an enclosed shaped body 40, due to the cover 15 and the active element 5, no connection is required, neither to the active element 5 nor to the cover 15, since the individual segments 37" are disposed side-by-side, supporting one another and are held from below by the active element 5. In this embodiment, the tensile force is preferably applied to both ends. In FIG. 15B a convexity element 40 modified by stretching of the active element 5 is shown, the new convexity 3' of which points into the direction opposite the original position.

Figure 16:
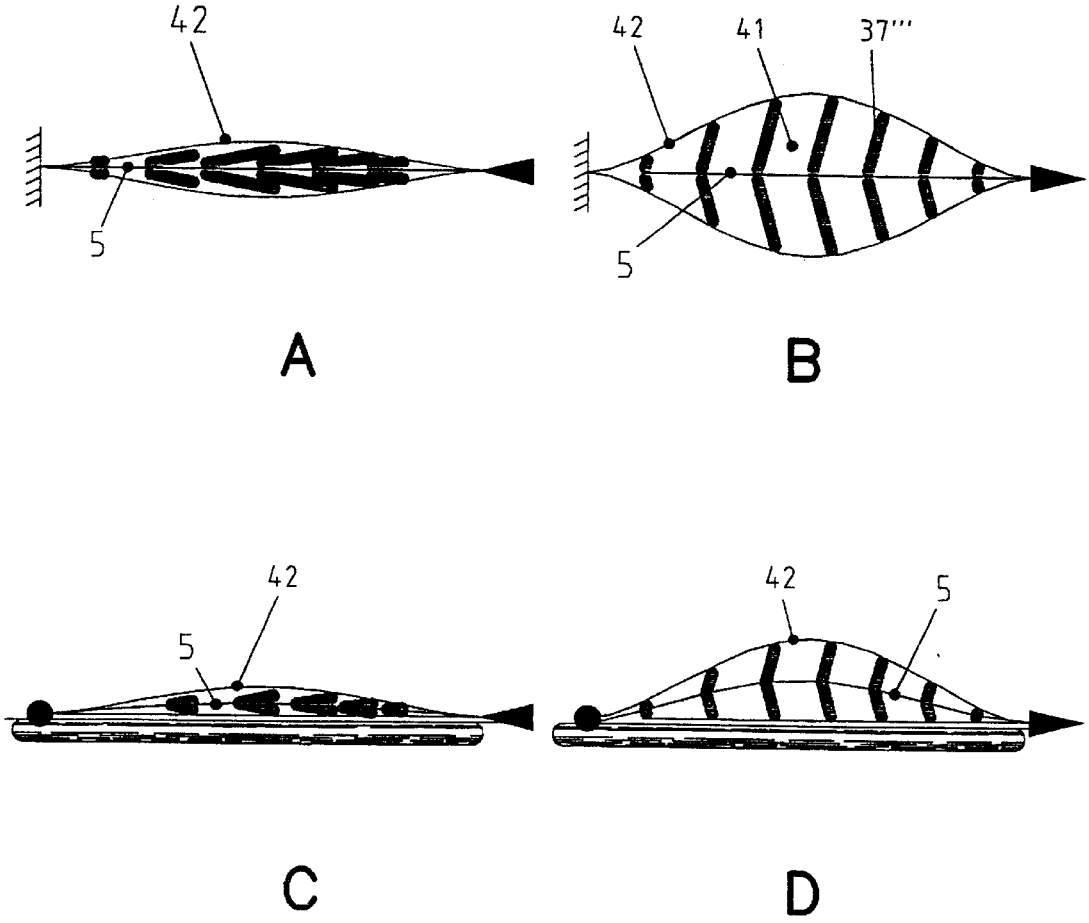
FIG. 16 shows diagrammatic views of a shaped body comprising segments arranged in a fishbone-like pattern, the body configuration and volume of which are variable.

FIG. 16 shows an embodiment of a shaped body 41, in which the individual segments 37'" are arranged in a fishbone-like pattern, the active element 5 being disposed in each case connected to them in an articulate manner between the upper and the lower segments 37'", where applicable even with a longitudinal slip. The free ends of the segments 37'" are mounted in an articulate manner in a flexible envelope 42, surrounding the shaped body 41. If a force is applied to the active element 5, rigidly connected in an articulate manner at one end to the last pair of segments with a slip, the shaped body 41, which in its original position, see FIG. 16A and C, is extremely flat, can be converted into a balloon-shaped body, see FIG. 16B and D. Provided there is no concavity or gap and the shaped body 41 is arranged on a surface, e.g. a level surface and a tensile force is applied to one side, the shaped body 41 out of the original position shown in FIG. 16C experiences a maximum balloon-shaped deformation as illustrated in FIG. 16D. In this process the active element 5 no longer forms a straight line but a curve.

Figure 17:
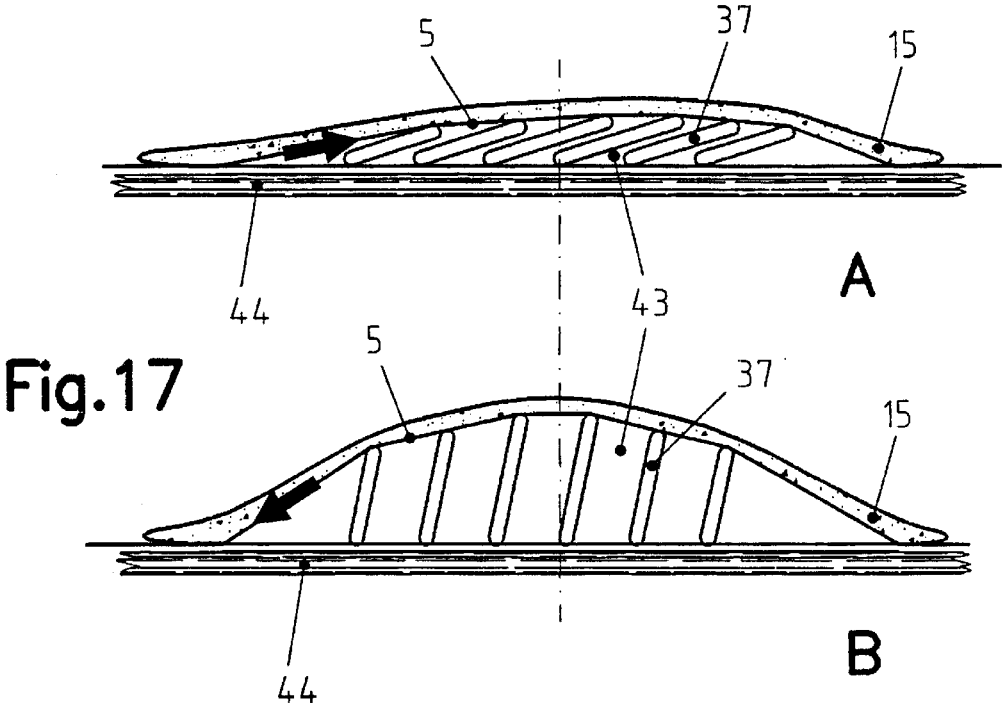
FIG. 17 shows cross-sections of a fourth embodiment of a shaped body comprising spaced apart segments, the body configuration and volume of which are variable.
Figure 18:
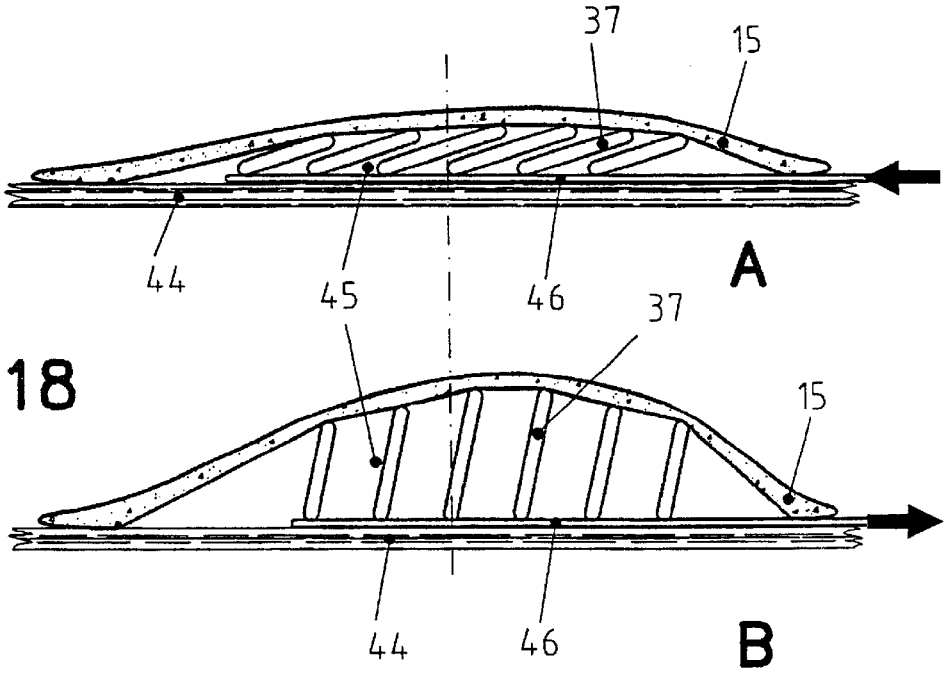
FIG. 18 shows cross-sections of a fifth embodiment of a shaped body comprising spaced apart segments, the body configuration and volume of which are variable.

FIGS. 17 and 18 show embodiments of a shape-variable shaped body 43, functioning e.g. on a plane or even on curved surfaces of any design, i.e. without a real concavity being present, into which the shaped body can be introduced or in which it is originally disposed. FIG. 17 shows a plate 44, on which the shaped body 43 is provided, comprising segments 37 of different height, fitted in an articulate manner to the plate 44 in spaced apart relationship, the free ends of which are connected to an active element 5 in an articulate manner, and on which, as the case may be, a cover 15 may be provided. In the position of rest shown in FIG. 17A the shaped body 43 adopts its flattest shape, i.e. its starting position. With the application of a tensile force onto the active element 5 in the direction of the arrow according to FIG. 17B the segments 37 rise and the shaped body 43 becomes curved. If the segments 37 are vertical in relation to the plate 44, the convexity attains the maximum vertex height. For the possible attainment of the vertex height a restoring force, e.g. in the form of a spring or shearing force, must be provided for pivoting the segments 37.

The embodiment of a shaped body 45 illustrated in FIG. 18 is structured in a way similar to the one described in FIG. 17. In this case the segments 37 are fitted in an articulate manner in spaced apart relationship on a preferably rigid active means 50 serving as the active element 5 rather than directly on the plate 44 as in the embodiment according to FIG. 17. In the present case the plate 44 serves as a support and/or guide means for the active element 5, e.g. a tension rod 46. The free ends of the segments 37 are in the present embodiment fitted to a cover 15 in an articulate manner. If a tensile force is applied in the direction of the arrow in FIG. 20B, the segments 37 are raised and a curved shaped body comes about according to their longitudinal dimensions and their disposition. In the event of the use of a dimensionally rigid active element 5, a reduction of the convexity can again be attained, in the case of further movement of the active element 5, up to a position, where the segments 37 are once again lying side-by-side, however in a direction opposite to the position shown in FIG. 18A. If the cover 15 has an inherent elasticity, i.e. is able to apply a force on the segments 37, the active element 5 may also comprise any flexible, tension-resistant material, as the return of the segments 37 into the starting position can then be effected by the resilience and the tension force of the cover 15, provided possible self-locking is excluded by appropriate measures.

By means of the embodiments shown in FIGS. 16 to 18, the deformation of a shaped body can be performed, enlarging its volume.

The individual components described as well as functionally similar components may be utilized in any desired combination for the manufacture of shaped bodies, just as the described individual shaped bodies may likewise be combined into units in any desired way.

What is claimed is:

1. A ergonomic support apparatus comprising:

An anchor disposed adjacent to an anatomical location to be supported;

A roller disposed adjacent to the anatomical location to be supported, said roller being further disposed on a side of the anatomical location to be supported opposite from said anchor;

A fabric web attached to said anchor and attached to said roller, said fabric web being displaceable between a stretched position that is flat relative to the anatomical location to be supported and a relaxed position that is concave relative to the anatomical location to be supported;

A tensioner that rotates said roller to selectively mediate stretching of said fabric web from said relaxed position to said stretched position; and A resilient support body attached to said fabric web such that said resilient support body is convex towards the anatomical location to be supported when said fabric web is in said stretched position and such that said resilient support body is flat relative to the anatomical location to be supported when said fabric web is in said relaxed position.

2. The ergonomic support of claim 1 wherein said tensioner is a coiling element.

3. The ergonomic support of claim 2 wherein said coiling element is eccentric.

4. The ergonomic support of claim 1 wherein said tensioner is self locking.

5. The ergonomic support of claim 1 wherein said tensioner is a cable.

6. The ergonomic support of claim 1 wherein said roller is comprised of at least one deflection point having a first position that holds said fabric web in said stretched position and said at least one deflection point having a second position that holds said fabric web in said relaxed position.

7. The ergonomic support of claim 1 wherein said fabric web has two ends, said ends having a spaced position and a closed position relative to each other, said spaced position of said two ends holding said fabric web in said relaxed position and said closed position of said two ends holding said fabric web in said stretched position.

8. The ergonomic support of claim 1 wherein said tensioner is operated by an actuator selected from the group consisting of; an electric motor, a hydraulic device, a pneumatic device, a cable and a manual device.

9. The ergonomic support of claim 1 wherein said fabric web is at least one flexible strip.

10. The ergonomic support of claim 1 further comprising a concave shell.

11. The ergonomic support of claim 10 wherein said concave shell in combination with said anchor, said roller, said fabric web, said tensioner and said resilient support body comprise an independent module.

12. The ergonomic support of claim 1 wherein said resilient support body is asymmetrical.

13. The ergonomic support of claim 1 wherein said resilient support body is stretchable longitudinally.

14. The ergonomic support of claim 1 wherein said resilient support body is transversely pressure resistant.

15. The ergonomic support of claim 1 further comprising:

an enveloping element disposed on a side of said resilient support body opposite said fabric web.

16. The ergonomic support of claim 1 wherein said resilient support body is folded longitudinally such that said resilient support body has transverse folds.

17. The ergonomic support of claim 1 wherein said fabric web is within said resilient support body.

18. The ergonomic support of claim 1 wherein said fabric web and said tensioner are the same element.

19. The ergonomic support of claim 1 further comprising a traction device operatively engaged with said tensioner.

20. The ergonomic support of claim 1 wherein said tensioner exerts tension continuously.

21. The ergonomic support of claim 1 wherein said tensioner exerts tension incrementally.

22. The ergonomic support of claim 1 wherein said resilient support body is nondeformable.

23. The ergonomic support of claim 1 further comprising a second resilient support body.

24. The ergonomic support of claim 1 wherein said second resilient support body moves in unison with said first resilient support body.

25. The ergonomic support of claim 1 wherein said fabric web is stretchable.

26. The ergonomic support of claim 1 wherein said resilient support body is segmented.

27. The ergonomic support of claim 1 wherein said resilient support body has incisions.

28. The ergonomic support of claim 1 further comprising:

an enveloping element disposed on a side of said resilient support body opposite said fabric web;

a plurality of battens, each having a first end and a second end, said first end of each of said battens being in pivoting contact with said fabric web, and said second end of each of said battens being in pivoting contact with said enveloping element such that when said fabric web is in said relaxed position, said battens are substantially flat relative to the anatomical location to be supported and such that when said fabric web is in said stretched position said battens are substantially perpendicular to said fabric web.

29. The ergonomic support of claim 28 wherein said battens overlap when said fabric web is in said relaxed position.

30. The ergonomic support of claim 28 wherein said fabric web is further displaceable to a third position wherein said battens form an apex in a convexity of said enveloping element, said apex of said third position being different from an apex of said enveloping element formed when said fabric web is in said stretched position.

31. The ergonomic support of claim 28 further comprising a second enveloping element on an opposite side of said resilient support body from said first enveloping element.

32. The ergonomic support of claim 31 further comprising a second plurality of battens, each of said second plurality of battens having a first end and a second end, said first end of each of said second plurality of said battens being in pivoting contact with said fabric web, and said second end of each of said second plurality of battens being in pivoting contact with said second enveloping element such that when said fabric web is in said relaxed position, each of said second plurality of battens are substantially flat relative to the anatomical location to be supported and such that when said fabric web in said stretched position each of said second plurality of battens are substantially perpendicular to said fabric web.

33. The ergonomic support of claim 31 wherein said fabric web is further displaceable to a third position wherein said resilient support body forms an apex, said apex of said third position being different from an apex of said resilient support body formed when said fabric web is in said stretched position.

* * * * *

UNITED STATES PATENT AND TRADEMARK OFFICE

CERTIFICATE OF CORRECTION

PATENT NO. : 6,460,208 B1
DATED : October 8, 2002
INVENTOR(S) : Wilhelm Schuster It is certified that error appears in the above-identified patent and that said Letters Patent is hereby corrected as shown below:

Column 12,
Line 23, "web in" should be -- web is in --

Signed and Sealed this

Eighteenth Day of February, 2003

JAMES E. ROGAN
*Director of the United States Patent and Trademark Office*